US009057575B2

(12) United States Patent
Shipman

(10) Patent No.: US 9,057,575 B2
(45) Date of Patent: Jun. 16, 2015

(54) CLEANING COMPONENTS FOR MAINTAINING A FIREARM

(75) Inventor: Kel Shipman, Canandaigua, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 106 days.

(21) Appl. No.: 13/475,638

(22) Filed: May 18, 2012

(65) Prior Publication Data

US 2012/0304409 A1 Dec. 6, 2012

Related U.S. Application Data

(60) Provisional application No. 61/488,539, filed on May 20, 2011, provisional application No. 61/587,426, filed on Jan. 17, 2012.

(51) Int. Cl.
*F41A 29/02* (2006.01)

(52) U.S. Cl.
CPC ..... *F41A 29/02* (2013.01)

(58) Field of Classification Search
CPC ..... F41A 29/02
USPC ..... 42/95; 15/104.2, 104.16
See application file for complete search history.

(56) References Cited

U.S. PATENT DOCUMENTS

| | | | | |
|---|---|---|---|---|
| 190,123 | A | | 5/1877 | Budd |
| 358,304 | A | | 2/1887 | Simpson |
| 2,361,395 | A | | 10/1944 | Gilligan |
| 2,420,044 | A | | 5/1947 | Jowett |
| 2,544,847 | A | | 3/1951 | Malesky |
| 2,559,376 | A | | 7/1951 | Schnitger |
| 2,796,101 | A | | 6/1957 | Hasemann et al. |
| 4,144,609 | A | | 3/1979 | Dubs |
| 4,399,627 | A | | 8/1983 | Malesky et al. |
| 4,547,924 | A | | 10/1985 | Brygider |
| 4,716,673 | A | * | 1/1988 | Williams et al. ..... 42/95 |
| 4,901,465 | A | | 2/1990 | Hsu |
| 4,962,607 | A | | 10/1990 | Baldwin |
| 5,038,509 | A | | 8/1991 | Stephan |
| 5,317,827 | A | | 6/1994 | Jaremco |
| 5,337,505 | A | | 8/1994 | Brown et al. |

(Continued)

FOREIGN PATENT DOCUMENTS

| | | | |
|---|---|---|---|
| EP | 602733 | A1 | 6/1994 |
| WO | WO-2010037047 | A1 | 4/2010 |

OTHER PUBLICATIONS http://www.gngtools.com/gngboltcleanerandpolisher-1.aspx dated Apr. 19, 2012 (2 pgs).

(Continued)

*Primary Examiner* — Stephen M Johnson
(74) *Attorney, Agent, or Firm* — Harris Beach PLLC

(57) ABSTRACT

A cleaning tool for maintaining a firearm includes a flexible brush adapter having a first end and an opposing second end. The flexible brush adapter includes a rotation-resistant cable characterized by two or more layers of strands having differing directions of lay. The cleaning tool further includes a brush attachment coupled to the flexible brush adapter at the second end thereof. The brush attachment includes a plurality of bristles. In one example, the brush attachment comprises a longitudinal twisted wire spine. The spine captures the plurality of bristles extending radially therefrom. The bristles include copper alloy bristles intermixed with stainless steel bristles.

7 Claims, 4 Drawing Sheets

(56) References Cited

U.S. PATENT DOCUMENTS

| | | | | |
|---|---|---|---|---|
| 5,357,705 | A | 10/1994 | Stengel | |
| 5,447,572 | A | 9/1995 | LaClair | |
| 5,557,871 | A * | 9/1996 | LaLonde | 42/95 |
| 5,871,589 | A | 2/1999 | Hedge | |
| 6,269,579 | B1 | 8/2001 | Warner | |
| 6,630,034 | B1 | 10/2003 | Schnell | |
| 6,758,005 | B2 | 7/2004 | Teper | |
| 7,165,673 | B2 | 1/2007 | Marks | |
| 7,272,921 | B2 * | 9/2007 | Misrachi | 57/237 |
| 7,356,961 | B2 | 4/2008 | Williams | |
| 7,441,363 | B1 | 10/2008 | Black et al. | |
| 7,644,529 | B2 | 1/2010 | Hopper et al. | |
| 2006/0236584 | A1 | 10/2006 | Williams | |
| 2007/0294930 | A1 | 12/2007 | Mays | |
| 2009/0199345 | A1 | 8/2009 | Morgan | |
| 2010/0163073 | A1 * | 7/2010 | Lyngstadaas et al. | 134/8 |
| 2010/0186769 | A1 | 7/2010 | Jaquish et al. | |
| 2011/0047852 | A1 | 3/2011 | Loftin | |
| 2011/0047853 | A1 | 3/2011 | Williams | |
| 2011/0083354 | A1 | 4/2011 | Krieger | |
| 2011/0168207 | A1 | 7/2011 | Smith | |

OTHER PUBLICATIONS http://www.m-guns.com/tool_new.php?product=moacks dated Apr. 19, 2012 (2 pgs).

http://www.brownells.com/.aspx/pid=31833/Product/AR-15-M16-BOLT-RADIUS-SCRAPER dated Apr. 19, 2012 (1 pg).

http://www.botachtactical.com/kzcrtcareto.html dated Apr. 19, 2012 (2 pgs).

http://slickguns.com/product/kz-m4crst-carbon-removal-super-tool-1438-after-coupon-free-shipping dated Apr. 19, 2012 (2 pgs).

ISA/US International Search Report and Written Opinion for corresponding International Application No. PCT/US12/38635 dated Aug. 1, 2012 (7 pgs).

European Patent Office, Supplementary European Search Report for Corresponding European Application No. EP12789572 dated Sep. 25, 2014 (6 pgs).

* cited by examiner

CLEANING COMPONENTS FOR MAINTAINING A FIREARM

CROSS REFERENCE TO RELATED APPLICATION

Reference is made to and this application claims priority from and the benefit of U.S. Provisional Application Ser. No. 61/488,539, filed May 20, 2011, entitled "BOLT AND BOLT CARRIER CLEANING SYSTEM AND TOOLS WITH INTEGRATED PULL-THROUGH HANDLE", and U.S. Provisional Application Ser. No. 61/587,426, filed Jan. 17, 2012, entitled "MULTIPURPOSE TOOL AND BRUSH FOR MAINTAINING A FIREARM", which applications are incorporated herein in their entirety by reference.

FIELD OF THE INVENTION

This disclosure relates generally to firearm cleaning tools and, more specifically, to components for cleaning a bolt carrier and chamber for firearms such as an M4, an M16, and other rifles and carbines, for example.

BACKGROUND OF THE INVENTION

Carbon and other residue from gunpowder and from firearm discharge reactions accumulate on firearm components over time, with deleterious effects on cleanliness, performance, and longevity of the firearm. Firearm discharge residue accumulates on various firearm components that require disassembly to access and clean. Even then, carbon and other discharge residue tends to be tenacious and difficult to remove. Some firearm components typically need to be scraped with a hard scraping tool to have discharge residue effectively removed, but this must be done without scratching or damaging the firearm components themselves. Various firearm components also have complex shapes that make cleaning discharge residue effectively a challenge. For example, the bolt and bolt carrier of a 5.56 or 7.62 cartridge rifle have complicated shapes that have proven to be persistently difficult to clean effectively. A number of specialized scraping tools have been introduced to clean firearm components, but have had substantial shortcomings.

SUMMARY OF THE INVENTION

In accordance with one aspect of the disclosure, a cleaning tool for maintaining a firearm includes a flexible brush adapter having a first end and an opposing second end. The flexible brush adapter includes a rotation-resistant cable characterized by two or more layers of strands having differing directions of lay. The cleaning tool further includes a brush attachment coupled to the flexible brush adapter at the second end thereof. The brush attachment includes a plurality of bristles.

In another aspect of the disclosure, the brush attachment comprises a longitudinal twisted wire spine. The spine captures the plurality of bristles extending radially therefrom. The bristles include soft bristles intermixed with stiff bristles.

In another aspect of the disclosure, the soft bristles are formed of a copper alloy and the stiff bristles are formed of stainless steel.

In yet another aspect of the disclosure, a firearm carrier chamber cleaning tool includes a body having a first end and an opposing second end, and a brush base attached to the second end of the body. The carrier chamber cleaning tool further includes a plurality of bristles extending axially from the brush base. The bristles are arranged in groups forming a circumferential pattern around the base. The circumferential pattern can include an odd number of evenly-spaced groups, or an even number of unevenly-spaced groups. The carrier chamber cleaning tool further includes an attachment portion fixed to the first end of the body.

In yet another aspect of the disclosure, a firearm carrier chamber cleaning tool includes a body having a first end and an opposing second end, and a plurality of bristles extending axially from the body. The bristles are formed of stiff segments of a wire rope cable. The carrier chamber cleaning tool further includes an attachment portion fixed to the first end of the body.

In yet another aspect of the disclosure, a firearm cleaning brush includes a twisted wire spine, and a two-tiered brush attachment comprising a plurality of bristles captured by the spine and extending radially therefrom. The first tier includes copper alloy bristles intermixed with stainless steel bristles. The cleaning brush further includes an attachment portion fixed to the spine.

In one example, the second tier comprises only bristles formed of copper alloy, and the bristles in the second tier form a smaller radii than the intermixed bristles in the first tier.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views.

DETAILED DESCRIPTION OF ILLUSTRATIVE EMBODIMENTS

Figure 1:
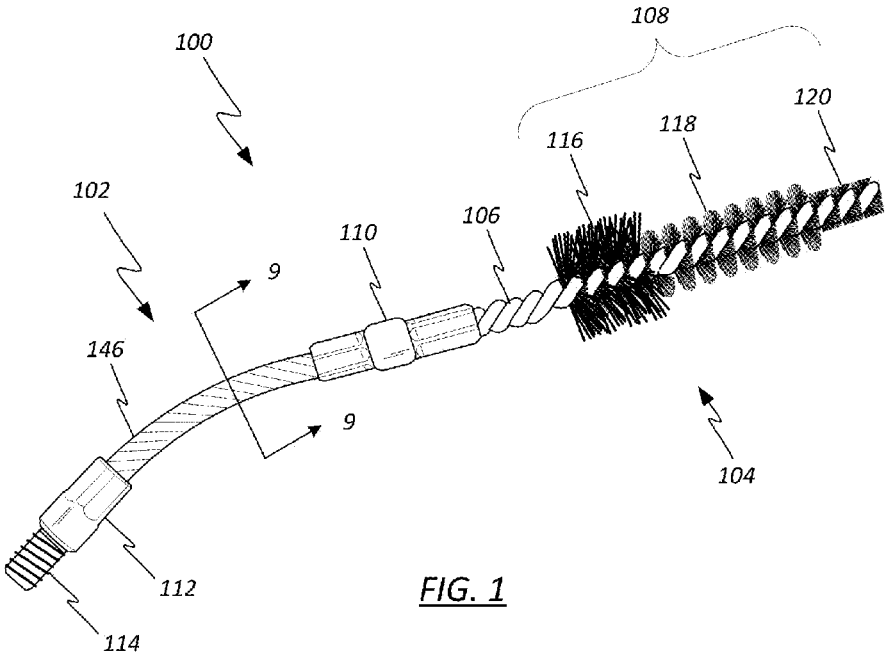
FIG. 1 depicts a side plan view of an illustrative embodiment of a chamber cleaning tool comprising a flexible brush adapter with a three-tiered brush attachment.

FIG. 1 depicts a side plan view of an illustrative embodiment of a chamber cleaning tool 100 comprising a flexible brush adapter 102 with a three-tiered brush attachment 104. Three-tiered brush attachment 104 includes a twisted wire longitudinal spine 106 that captures a plurality of wire brush bristles 108 extending radially from the spine. Three-tiered brush attachment 104 may be attached to flexible brush adapter 102 by a threaded attachment portion 110. In the illustrated embodiment, the threaded attachment portion 110 comprises a male end and is swaged onto the spine 106.

Flexible brush adapter 102 may also have a base portion 112 with a threaded attachment portion 114, by which it may be attached to still other implements.

In one embodiment, the spine 106 is formed of 14-gauge galvanized steel wire, which can be twisted in spiral fashion. The bristles 108 can be positioned on the wire prior to the twisting operation, such that the bristles are subsequently crimped in the spirals of the spine 106. The crimped bristles 108 can be arranged in sections of three bristle radii, including first brush section 116, second brush section 118, and third brush section 120, in this illustrative embodiment, with a descending order of bristle radius.

Figure 2:
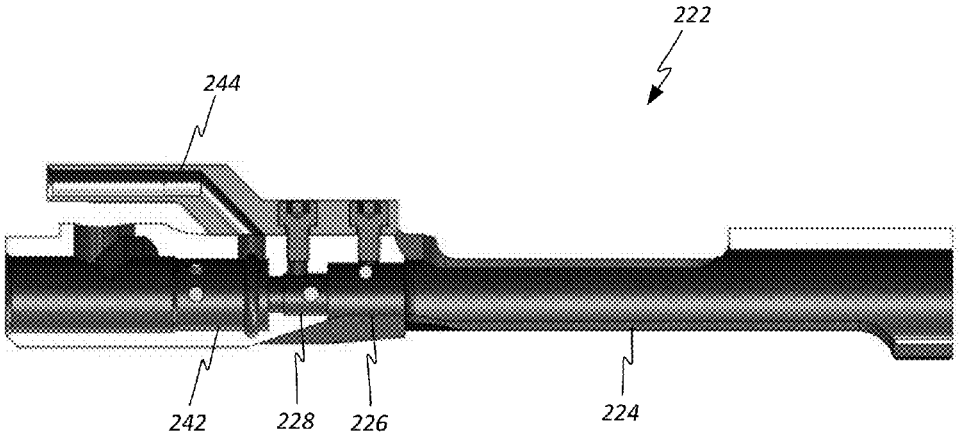
FIG. 2 depicts a side plan view of a bolt carrier, for reference.

Three-tiered brush attachment 104 may be particularly advantageous for cleaning the sides of the interior of a bolt carrier, for example. An illustrative bolt carrier 222 is shown in FIG. 2 for reference. Bolt carrier 222 includes an interior chamber 224 with a stepped second chamber section 226 and a stepped third chamber section 228, where interior chamber 224, second chamber section 226, and third chamber section 228 each have a different internal radius. Three-tiered brush attachment 104 may precisely and simultaneously match the three-tiered division of chamber portion radii in bolt carrier 222, such that when three-tiered brush attachment 104 is inserted within bolt carrier 222, first brush section 116 may conformingly engage with the interior surface of interior chamber 224, second brush section 118 may conformingly engage with the interior surface of second chamber section 226, and third brush section 120 may conformingly engage with the third chamber section 228.

Figure 3:
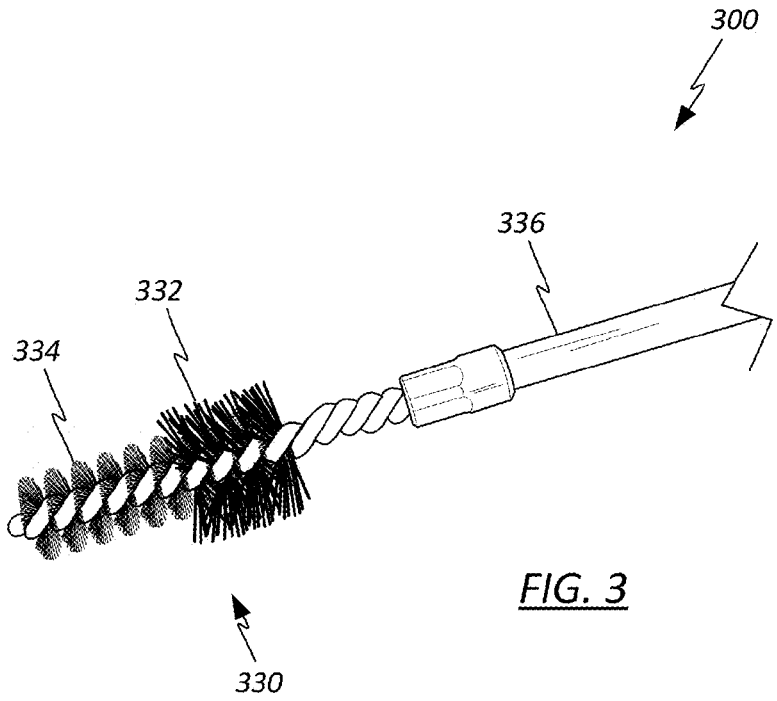
FIG. 3 depicts a side plan view of an illustrative embodiment of a portion of a cleaning tool comprising a two-tiered brush attachment.

FIG. 3 depicts a side plan view of an illustrative embodiment of a portion of a cleaning tool 300 comprising a two-tiered brush attachment 330. Two-tiered brush attachment 330 includes perpendicularly suspended wire brush bristles in sections of two bristle radii. Cleaning tool cleaning tool 300 may be used for cleaning the interior of a bolt carrier of a firearm, for example. Two-tiered brush attachment 330 has two sections of wire brush bristles, a first section 332 with longer bristles, and a second section 334 with shorter bristles. Two-tiered brush attachment 330 may be useful for brushing the interior of components such as a bolt carrier, for example. Two-tiered brush attachment 330 may be used to enter and clean the back of the bolt carrier where it effectively cleans both the recess that houses the firing pin and the center bore that receives the bolt, where the cleanliness and tolerance is important to keep the operation of the bolt. Cleaning tool 300 may also have a base 336 which may also have a threaded section, for threaded attachment to a rod or flexible brush adapter, for example.

In one embodiment of the present invention, the bristles of the two-tiered brush attachment 330 comprise both bristles formed of a soft material and bristles formed of a stiff material. In one example, the soft bristles comprise copper alloy, e.g., bronze or brass, and the stiff bristles are formed of stainless steel. The copper alloy and stainless steel bristles can be intermixed in at least a large diameter brush portion 332, in a ratio of about 1:1. The small diameter portion 334 optionally may comprise only copper alloy bristles. It has been found that the copper alloy bristles hold cleaning solvent better than the stainless steel bristles, and the stainless steel bristles are aggressive enough to clean out deposits of burned lacquer sealant used liberally in cheaper ammunition.

In one embodiment of the present invention, the crimped bronze bristles and crimped stainless steel bristles can be mixed in a ratio of about 1:1, each about 0.006 inches in diameter, incorporated at a rate of about 123 bristles per 0.25 inch of brush length and extending over about 1.487 inches in length of large diameter portion 332 and diametrical width of about 0.405 inch. Crimped bronze bristles, each about 0.006 inches in diameter, may be incorporated at a rate of about 123 bristles per 0.25 inch of brush length and extending over about 0.89 inches in length of small diameter portion 334 and diametrical width of about 0.350 inch. The crimped bronze bristles and crimped stainless steel bristles can be mixed in groups or individually. For example, the bronze bristles can alternate with the stainless steel bristles. Or, the bronze bristles can be arranged in groups of five bristles, followed by a group of five stainless steel bristles. Higher-number groups of bristles, such as ten or twenty five, may provide advantages to certain cleaning methods.

Figure 4:
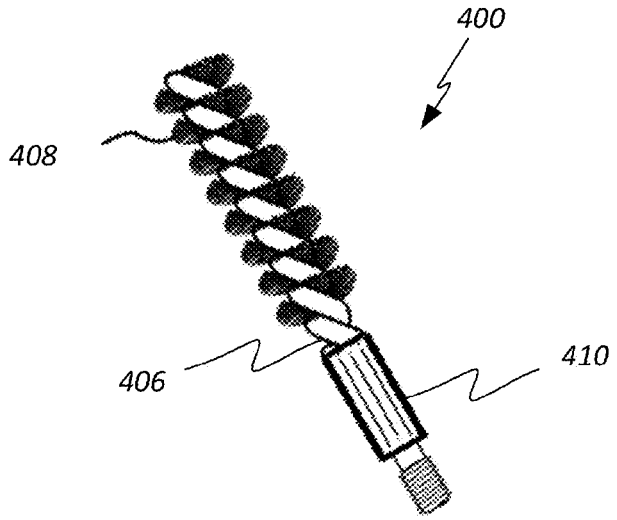
FIG. 4 depicts a side plan view of a portion of a cleaning tool comprising a single-radii brush attachment according to one embodiment of the present invention.

In other embodiments, soft bristles and stiff bristles can be intermixed within a single-radii brush attachment. Referring to FIG. 4, a cleaning tool 400 includes a spine 406 formed of 14-gauge galvanized steel wire, twisted in spiral fashion. Bristles 408 are positioned on the wire prior to the twisting operation, such that the bristles are subsequently crimped in the spirals of the spine 406. The crimped bristles 408 are formed and arranged as a single radii. A threaded attachment portion 410 is swaged onto spine 406. Bristles 408 are intermixed with a soft material best suited for retention of cleaning solvent and normal cleaning of carbon deposits, and the stiff bristles are best suited for aggressive cleaning of burned lacquer sealant, in one example. In one embodiment, the soft bristles are formed of a copper alloy, e.g., bronze or brass, and the stiff bristles are formed of stainless steel. In another embodiment, the soft bristles are formed of nylon and the stiff bristles are formed of a copper alloy. In yet another embodiment, the soft bristles are formed of nylon and the stiff bristles are formed of stainless steel.

Figure 5:
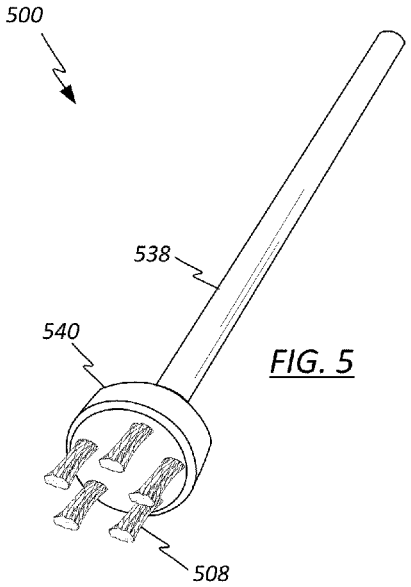
FIG. 5 depicts a perspective view of an illustrative embodiment of a carrier chamber brush attachment.
Figure 6:
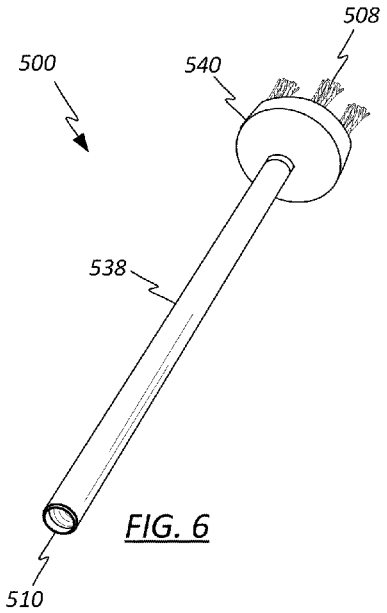
FIG. 6 depicts another perspective view of an illustrative embodiment of a carrier chamber brush attachment.

FIG. 5 depicts a perspective view of an illustrative embodiment of a carrier chamber brush 500, comprising a plurality of groups of axially extending bristles 508. Carrier chamber brush 500 has a body 538 with a brush base 540 attached thereto. Referring to the bolt carrier 222 depicted in FIG. 2, the bolt carrier includes an interior section 242 with a relatively flat interior back wall. Carrier chamber brush 500 may be ideally suited for extending into the interior section 242 and cleaning the back wall thereof. The back side of the bolt carrier chamber tends to receive a great deal of carbon deposits which are difficult to remove without scraping. The geometry of this area typically differs from one manufacturer to another, so a rigid scraper, regardless of its geometry, can only be partially effective. The carrier chamber brush 500 may be sized properly so that the bristles 508 flex into the open area which is back-bored and otherwise very difficult to reach with a fixed scraper geometry. FIG. 6 depicts another perspective view of carrier chamber brush 500, with body 538, brush base 540, and axially extending bristles 508. FIG. 6 also shows that body 538 may include a female threaded attachment portion 510 at the far end thereof from the brush base 540 and axially extending bristles 508, so that carrier chamber brush 500 may be threaded onto and attached to other handles or other implements in a tool kit.

Carrier chamber brush 500 has five evenly spaced groups of axially extending bristles 508 in this illustrative embodiment, and in other embodiments may have three or seven evenly spaced groups of bristles, or may have an even number of groups of bristles in an uneven arrangement, for example. For example, the carrier chamber brush 500 can include six groups of bristles in an uneven arrangement, although two or four groups are also contemplated. In each of these examples, the groups of bristles 508 form a circumferential pattern around the brush base 540. Each of these arrangements provides a particular advantage in light of a gas port 244 on the side of the bolt carrier (FIG. 2), so that when the carrier chamber brush 500 is used to scrape the interior of a bolt carrier, when one of the groups of bristles crosses the position of the gas port, there is not a diametrically opposite group of bristles pushing directly toward the gas port and providing a net off-axis force.

Figure 7:
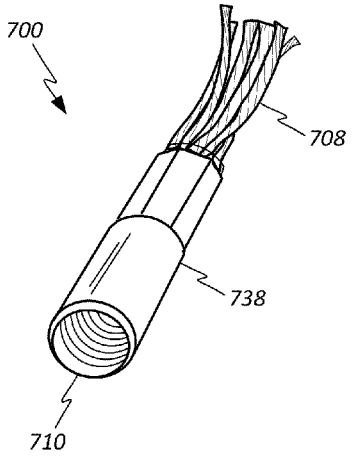
FIG. 7 depicts a perspective view of an illustrative embodiment of a carrier chamber brush attachment.
Figure 8:
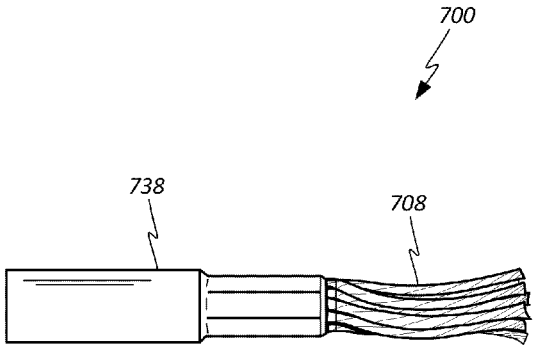
FIG. 8 depicts another perspective view of an illustrative embodiment of a carrier chamber brush attachment.

FIG. 7 depicts a perspective view of an illustrative embodiment of a carrier chamber brush 700. FIG. 8 depicts another perspective view of carrier chamber brush 700. Carrier chamber brush 700 includes a body 738 and brush bristles 708. Carrier chamber brush 700 may be well-suited for cleaning the interior of a carrier chamber or gas port 244 of a bolt carrier 222 as shown in FIG. 2. In particular, carrier chamber brush 700 may be created using the stiff segments typically used in a wire rope cable, in lieu of typical bristle material. Carrier chamber brush 700 may be particularly well-suited to scrape the back side of the carrier gas chamber using the stiff wire rope cable segment bristles, which may be cut to the proper length to be both stiff enough to scrape off carbon deposits, yet flexible enough to flex into areas that need to be scraped. Body 738 may include a female threaded attachment portion 710 at the far end thereof from the axially extending bristles 708, so that carrier chamber brush 700 may be threaded onto and attached to other handles or other implements in a tool kit.

Figure 9:
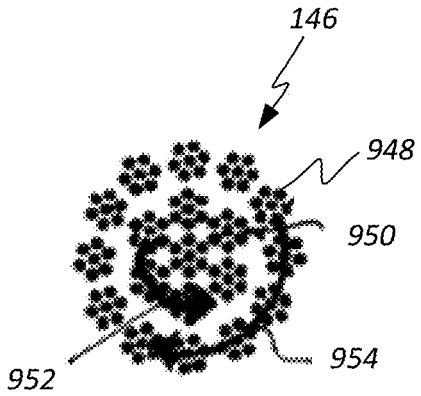
FIG. 9 depicts a cross-sectional view taken along line 9-9 of the flexible brush adapter shown in FIG. 1.

Referring now to FIGS. 1 and 9, in one embodiment of the present invention the flexible brush adapter 102 is formed of a length of rotation-resistant cable 146 such that a user attaching the adapter 102 to a brush may access the firing chamber without requiring a long rod to extend down the length of the barrel. The rotation-resistant cable 146 may be swaged at a first end to a female-thread fitting on the threaded attachment portion 110 and at a second end to a male-thread fitting on the base portion 112. The use of rotation-resistant cable allows a brush and the adapter 102 to be rotated both clockwise and counterclockwise during cleaning use without causing the cable to undesirably unwind, as occurs in prior art flexible adapters utilizing conventionally-wound single-direction cable. In the illustrated example, flexible brush adapter 102 is connected to the three-tiered brush attachment 104. However, the flexible brush adapter 102 may be connected to any suitable brush attachment, such as cleaning tools 300, 400, 500, and 700 depicted in FIGS. 3, 4, 5, and 7, respectively.

Rotation-resistant wire cables, also referred to herein as "counter-wound cables", are specially designed to resist spin or rotation while under load. Due to their design, they have certain restrictions on their application and special handling requirements that are unnecessary with other constructions. As shown in FIG. 9, the rotation-resistant characteristics are attained by a design of two or more layers 948, 950 of strands having differing directions of lay (e.g., counterclockwise direction 952 and clockwise direction 954). Under load, one layer's directional rotation is counteracted by the tendency of the other layer(s) to rotate in the opposite direction. To impart greater resistance to rotation, these cables are designed with a greater number of smaller diameter strands (when compared with the design of 6-strand constructions). The combination of smaller diameter strands and differing cable lays makes for a very delicate balance which can easily be "unbalanced" at any time. Die drawn rotation-resistant cables are especially susceptible to unbalancing. Extra care must be taken when handling, installing, and operating rotation resistant wire cables. They cannot and should not be treated in the same manner as conventional 6-strand constructions. Rotation-resistant cables are available from, for example, Wirerope Works, Inc., Williamsport, Pa., USA.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A cleaning tool for maintaining a firearm, comprising:

a flexible brush adapter having a first end and an opposing second end, the flexible brush adapter comprising a rotation-resistant cable comprising two or more layers of strands having differing directions of lay; and a brush attachment coupled to the flexible brush adapter at the second end thereof; the brush attachment comprising a longitudinal twisted wire spine capturing a plurality of bristles extending radially therefrom, the bristles comprising soft bristles intermixed with stiff bristles, wherein the soft bristles are formed of a copper alloy and the stiff bristles are formed of stainless steel.

2. A cleaning tool for maintaining a firearm, comprising:

a flexible brush adapter having a first end and an opposing second end, the flexible brush adapter comprising a rotation-resistant cable comprising two or more layers of strands having differing directions of lay; and a brush attachment coupled to the flexible brush adapter at the second end thereof; the brush attachment comprising a longitudinal twisted wire spine capturing a plurality of bristles extending radially therefrom, the bristles comprising soft bristles intermixed with stiff bristles, wherein the soft bristles are intermixed with the stiff bristles in a ratio of about 1:1.

3. A cleaning tool for maintaining a firearm, comprising:

a flexible brush adapter having a first end and an opposing second end, the flexible brush adapter comprising a rotation-resistant cable comprising two or more layers of strands having differing directions of lay; and a brush attachment coupled to the flexible brush adapter at the second end thereof; the brush attachment comprising a longitudinal twisted wire spine capturing a plurality of bristles extending radially therefrom, the brush attachment comprising a two-tiered brush attachment having a first section with long bristles and a second section having short bristles, the long bristle section comprising soft bristles intermixed with stiff bristles, the soft bristles being formed of a copper alloy and the stiff bristles being formed of stainless steel.

4. The cleaning tool according to claim 3, wherein the soft bristles are intermixed with the stiff bristles in a ratio of about 1:1.

5. A firearm cleaning brush, comprising:

a twisted wire spine;

a two-tiered brush attachment comprising a plurality of bristles captured by the spine and extending radially therefrom, the first tier comprising copper alloy bristles intermixed with stainless steel bristles; and an attachment portion fixed to the spine; and wherein the copper alloy bristles are intermixed with the stainless steel bristles in a ratio of about 1:1.

6. The firearm cleaning brush according to claim 5, wherein the second tier comprises only bristles formed of copper alloy, the bristles in the second tier forming a smaller radii than the intermixed bristles in the first tier.

7. The firearm cleaning brush according to claim 5, wherein the captured copper alloy bristles and captured stainless steel bristles are mixed in groups.

* * * * *